US008899574B2

(12) United States Patent
Okano et al.

(10) Patent No.: US 8,899,574 B2
(45) Date of Patent: Dec. 2, 2014

(54) IMAGE FORMING APPARATUS

(71) Applicants: Tetsuya Okano, Anjyo (JP); Takashi Suzuki, Nagoya (JP); Fei Cheng, Nagoya (JP)

(72) Inventors: Tetsuya Okano, Anjyo (JP); Takashi Suzuki, Nagoya (JP); Fei Cheng, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/852,753

(22) Filed: Mar. 28, 2013

(65) Prior Publication Data

US 2014/0001698 A1 Jan. 2, 2014

(30) Foreign Application Priority Data

Jun. 29, 2012 (JP) ..... 2012-147812

(51) Int. Cl.
*B65H 5/00* (2006.01)
*B65H 7/00* (2006.01)
*B65H 7/04* (2006.01)

(52) U.S. Cl.
CPC .. *B65H 5/00* (2013.01); *B65H 7/00* (2013.01); *B65H 7/04* (2013.01)
USPC ..... 271/9.09; 399/71; 399/34

(58) Field of Classification Search
CPC ..... B65H 7/00; B65H 7/04; B65H 5/00
USPC ..... 271/145, 9.09; 399/101, 100, 75, 127, 399/128, 23, 43, 71, 392, 393
See application file for complete search history.

(56) References Cited

U.S. PATENT DOCUMENTS

| | | | | |
|---|---|---|---|---|
| 4,330,199 | A * | 5/1982 | Komori et al. | 399/127 |
| 4,908,673 | A | 3/1990 | Muramatsu | |
| 5,216,472 | A | 6/1993 | Muto et al. | |
| 6,205,303 | B1 * | 3/2001 | Fujii et al. | 399/100 |
| 6,567,626 | B2 * | 5/2003 | Akaike et al. | 399/75 |
| 7,068,957 | B2 * | 6/2006 | Shimura et al. | 399/49 |
| 7,653,329 | B2 * | 1/2010 | Sasai | 399/127 |
| 2002/0061203 | A1 * | 5/2002 | Akaike et al. | 399/75 |
| 2009/0010662 | A1 * | 1/2009 | Naoi et al. | 399/44 |
| 2011/0097129 | A1 | 4/2011 | Hashimoto | |
| 2014/0003831 | A1 * | 1/2014 | Endo | 399/75 |

FOREIGN PATENT DOCUMENTS

| | | | |
|---|---|---|---|
| JP | 01-104526 | A | 4/1989 |
| JP | 04-080160 | A | 3/1992 |
| JP | 06-089052 | A | 3/1994 |
| JP | 09-218547 | A | 8/1997 |
| JP | 2000-012752 | A | 1/2000 |
| JP | 2002-156884 | A | 5/2002 |
| JP | 2007-076782 | A | 3/2007 |
| JP | 2011-093160 | A | 5/2011 |

* cited by examiner

*Primary Examiner* — Patrick Cicchino
(74) *Attorney, Agent, or Firm* — Banner & Witcoff, Ltd.

(57) ABSTRACT

An image forming apparatus including: a sheet feeding section; an image forming section configured to form an image on the sheet fed from the sheet feeding section; and a control device configured to: cause the image forming section to form the image, cause the image forming section to perform a quality assurance operation, if a resource necessary for the image forming operation is not available for a predetermined time from an end of the image forming operation, and extend the predetermined time when determined that it is necessary for the user to set the sheet in the sheet feeding section prior to the image forming operation to be longer than the predetermined time when determined that it is not necessary for the user to set the sheet in the sheet feeding section prior to the image forming operation.

10 Claims, 7 Drawing Sheets

IMAGE FORMING APPARATUS

CROSS-REFERENCE TO RELATED APPLICATIONS

This application claims priority from Japanese Patent Application No. 2012-147812 filed on Jun. 29, 2012, the entire contents of which are incorporated herein by reference.

TECHNICAL FIELD

Aspects of the present invention relate to an image forming apparatus, and more particularly, to a quality assurance operation pertaining to image formation of an image forming apparatus.

BACKGROUND

An example of a control technique of determining that an image forming process of forming an image on a sheet by an image forming apparatus is completed and stopping operation of an image forming section is disclosed in JP-A-2002-156884. In JP-A-2002-156884, a technique is disclosed in which if a next image forming operation is prepared before a predetermined time has elapsed from an end of the image forming operation, the next image forming operation is performed, while if a resource necessary for the image forming operation is not available even though the predetermined time has elapsed from the end of the image forming operation, cleaning (quality assurance operation) is performed.

However, in the technique disclosed in JP-A-2002-156884, in a case where a user needs to set the sheet in a sheet feeding section prior to the image forming operation, the supply of the sheet to the image forming section may be delayed, as compared with the image forming operation in which the user does not need to set the sheet in the sheet feeding section. In this instance, if the predetermined time for determining whether or not to proceed to the cleaning is short, the quality assurance operation, such as cleaning, is performed, even though the user wants to set the sheet in the sheet feeding section and then perform the image forming operation. Therefore, productivity may be decreased.

SUMMARY

An aspect of the present invention is to provide a technique for securing the productivity by suppressing performing the quality assurance operation easily.

According to an aspect of the present invention, there is provided an image forming apparatus including: a sheet feeding section, an image forming section, and a control device. The sheet feeding section is configured to feed a sheet. The image forming section is configured to perform an image forming operation of forming an image on the sheet fed from the sheet feeding section. The control device is configured to: cause the image forming section to perform the image forming operation, cause the image forming section to perform a quality assurance operation for assuring a quality of an image, if a resource necessary for the image forming operation is not available for a predetermined time from an end of the image forming operation, determine whether or not it is necessary for a user to set the sheet in the sheet feeding section prior to the image forming operation, and extend the predetermined time when it is determined that it is necessary for the user to set the sheet in the sheet feeding section prior to the image forming operation to be longer than the predetermined time when it is determined that it is not necessary for the user to set the sheet in the sheet feeding section prior to the image forming operation.

In a case where it is necessary for the user to set the sheet in the sheet feeding section prior to the image forming operation, for example, in a case of manual sheet feeding printing, the supply of the sheet to the image forming section may be delayed, as compared with the image forming operation in which the user does not need to set the sheet in the sheet feeding section, for example, tray sheet feeding printing. However, according to this configuration, even in the case where the user needs to set the sheet in the sheet feeding section, since the predetermined time until the quality assurance process is performed is extended from the end of the image forming operation, it is possible to secure the productivity by suppressing the process from transferring to the quality assurance operation easily.

DETAILED DESCRIPTION

Figure 1:
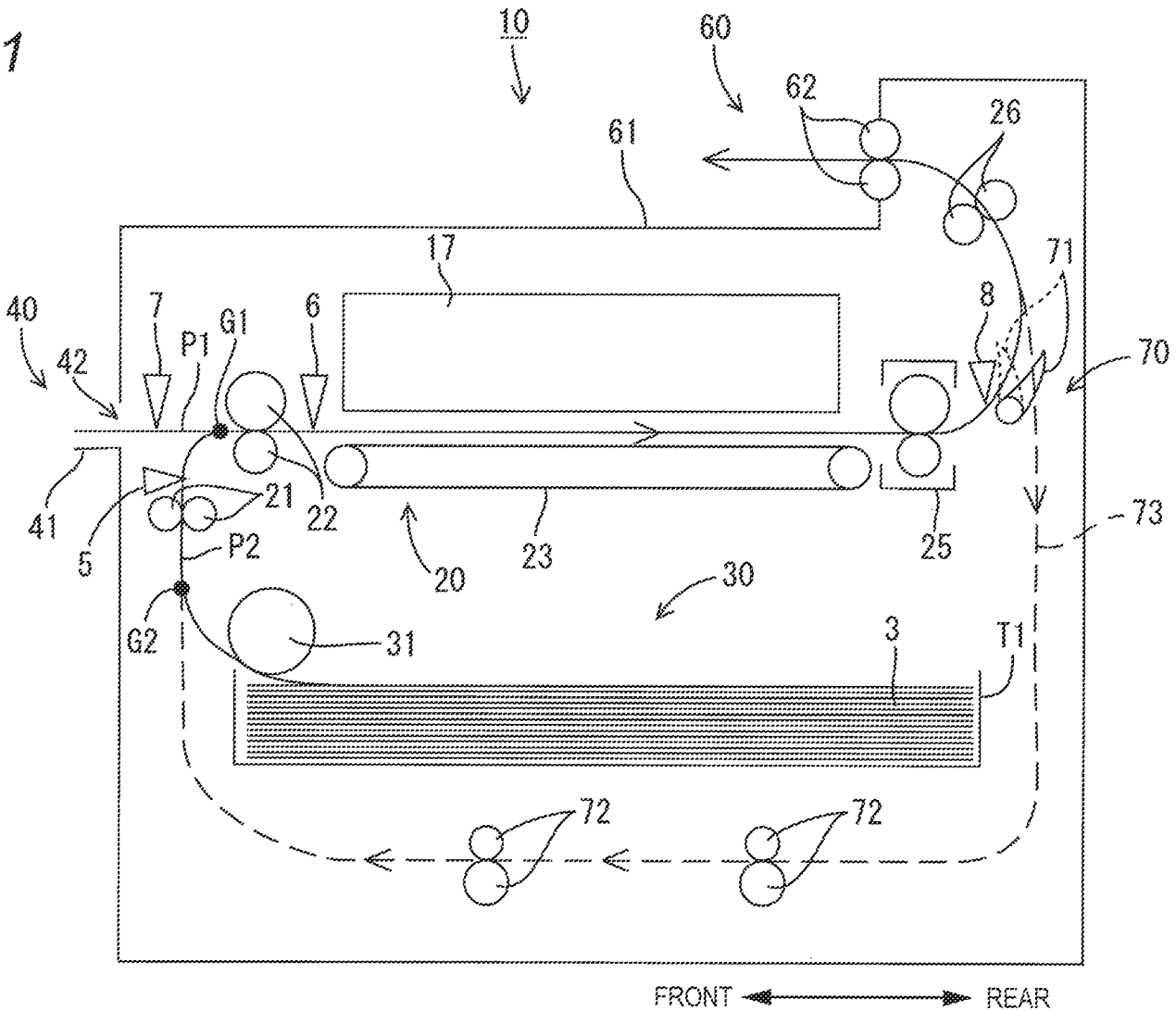
FIG. 1 is a schematic view illustrating an internal configuration of a printer according to an exemplary embodiment of the present invention.

Next, an exemplary embodiment of the present invention will be described with reference to FIGS. 1 to 7.

1. Internal Configuration of Printer

The internal configuration of a printer 10 will be described with reference to FIG. 1.

The printer 10 is, for example, a color LED printer of a direct tandem type capable of forming a color image using toners of four colors (black K, yellow Y, magenta M, and cyan C). In the following description, a left side in a horizontal direction (X-axis direction) in FIG. 1 is referred to as a front side. Meanwhile, the image forming apparatus is not limited to the color printer of the direct tandem type, but, for example, may also be a color laser printer, a monochromatic printer, or a multifunction machine with a copying function and a facsimile function. Further, the image forming apparatus may also be a printer of an electrophotographic type or a printer of an inkjet type.

The printer 10 includes an image forming section 17, a conveyance mechanism 20, a fixing unit 25, a tray sheet feeding section 30, a manual sheet feeding section 40, a sheet reversing mechanism 70, a first conveyance path P1, and a second conveyance path P2.

The tray sheet feeding section (one example of the sheet feeding section) 30 is provided at a bottom portion of the printer 10 and includes a tray T1 and a pick-up roller 31. The tray sheet feeding section 30 feeds a plurality of sheets (an example of the sheet and the resource necessary for image forming operation) 3, which is set in a tray by a user, to the second conveyance path P2.

The manual sheet feeding section (one example of the sheet feeding section) 40 is provided at a front surface of the printer 10 and includes a door 41 and an opening 42. The manual sheet feeding section 40 feeds the sheet 3, which is inserted by the user each time an image forming operation is performed to a sheet 3, to the first conveyance path P1, at the time of manual sheet feed printing. In this instance, the door 41 is opened by the user, and the sheet 3 is fed to the first conveyance path P1 one by one through the opening 42.

The first conveyance path P1 is a path used when an image is formed on the sheet 3 fed from the manual sheet feeding section 40. That is, the first conveyance path P1 is a path used when manual feeding printing is performed to the sheet 3. The first conveyance path P1 almost corresponds to a path from the opening 42 to a junction point G1 with the second conveyance path P2, as illustrated in FIG. 1.

The second conveyance path P2 is a conveyance path from the tray T1 to the image forming section 17, and, as illustrated in FIG. 1, almost corresponds to a path from a pick-up roller 31 of the tray sheet feeding section 30 to the fixing unit 25. The sheet 3 fed from the tray sheet feeding section 30 passes the second conveyance section P2 to form the image on the sheet by the image forming section 17. The second conveyance path P2 is joins with the first conveyance path P1 at the junction point G1.

The image forming section 17 forms the image on the sheet 3 conveyed via the tray sheet feeding section 30 or the first conveyance path P1. The image forming section 17 includes, for example, a developer receiving unit, a developing unit, an image carrying unit, and a transfer unit, for every color, and forms the image on the sheet 3 in an electrophotographic manner. That is, the image forming section 17 forms an image (monochrome image or color image) on the sheet 3 conveyed by the belt 23, for example, based on print data (an example of the image data and the resource necessary for image forming operation) received from a PC. The sheet 3 formed with the image is thermally fixed by the fixing unit 25, and then is discharged onto the discharge tray 61.

A discharge section 60 includes a discharge tray 61 and a discharge roller 62. The sheet 3 with the image formed by the image forming section 17 is discharged to the discharge tray 61. Also, the discharge section 60 feeds the sheet 3 to a reverse conveyance path 73 (portion indicated by the dotted-line arrow in FIG. 1) when duplex printing is performed to the sheet 3.

The conveyance mechanism 20 conveys the sheet 3 in the respective conveyance paths P1, P2 and 73. The conveyance mechanism 20 includes, as illustrated in FIG. 1, an auxiliary sheet feeding roller 21, a registration roller 22, a conveyance belt 23, a forward/reverse roller 26, and the sheet reversing mechanism 70.

The auxiliary sheet feeding roller 21 conveys the sheet 3 taken out from the tray T1 by the pick-up roller 31 to the registration roller 22. The registration roller 22 adjusts the posture of the conveyed sheet 3, and then feeds it to the belt 23 at a predetermined timing.

The sheet reversing mechanism 70 has a flapper 71, a plurality of reverse conveyance rollers 72, a reverse conveyance path (an example of the second conveyance path and the re-conveyance path) 73, and a discharge roller 62. The reverse conveyance path 73 is indicated by the dotted-line arrow in FIG. 1. In this instance, as illustrated in FIG. 1, the second conveyance path P2 joins with the reverse conveyance path 73 at a junction point G2. That is, the second conveyance path P2 and the reverse conveyance path 73 become a common conveyance path from the junction point G2 to the junction point G1.

For example, if duplex printing operation (DX printing) is performed to the sheet 3 fed from the tray sheet feeding section 30 in a manner such that printing of another side of the sheet 3 is continuously performed after the printing of one side of the sheet 3, the image is printed on a back side (lower surface when the document is placed in the tray T1) of the sheet 3 by the image forming section 17, and then the sheet 3 is conveyed to the discharge roller 62. By the reverse rotation of the discharge roller 62 and the forward/reverse roller 26, the sheet 3 is conveyed via the flapper 71, the plurality of reverse conveyance rollers 72, the auxiliary sheet feeding roller 21, and the registration roller 22, and thus is fed onto the belt 23 in a state in which front and back sides thereof are reversed. The sheet 3 is discharged onto the discharge tray 61 after the image is printed on the front side (upper surface when the sheet is placed in the tray T1) by the image forming section 17.

When the duplex printing operation (DX printing) is performed to the sheet 3 fed from the manual sheet feeding section 40, only an order of printing the image on the front and back side of the sheet is different from that when the sheet 3 is fed from the tray sheet feeding section 30. That is, in the case of the duplex printing from the manual sheet feeding section 40, the image is first printed on the upper surface of the sheet 3 when being inserted from the manual sheet feeding section 40.

The first conveyance path P1 is provided with a manual sheet feeding sensor (one example of the second detection unit) 7 for detecting passing of the sheet 3 through the first conveyance path P1 and supplying a second detected signal to a CPU (control device) 11.

Also, a post-registration sensor (one example of the first detection unit) 6 is provided at a downstream side of the registration roller 22 in the sheet conveying direction to detect passing of the sheet 3 through the junction point G1 of the first conveyance path P1 and the second conveyance path P2 and supply the first detection information to the CPU 11. Also, a discharge sensor 8 is installed at the downstream side of the fixing unit 25 in the sheet conveying direction.

2. Electrical Configuration of Printer

Figure 2:
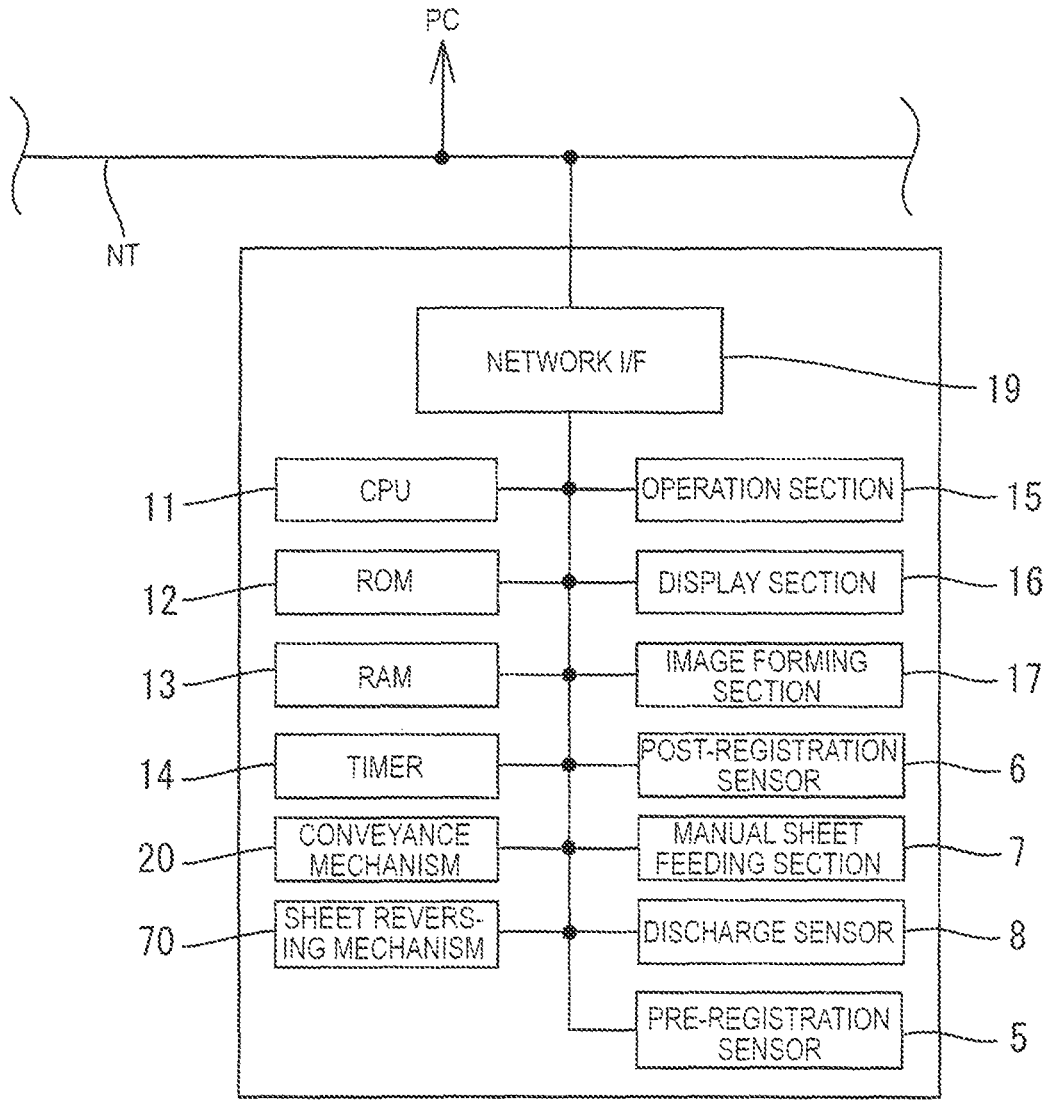
FIG. 2 is a block diagram schematically illustrating an electrical configuration of the printer.

Next, the electrical configuration of the printer 1 will be described with reference to FIG. 2.

The printer 10 includes the CPU 11 (one example of the control device), a ROM 12, and a RAM 13, which are connected to a timer 14, an operation section 15, a display section 16, the image forming section 17, a network interface 19, a pre-registration sensor 5, the post-registration sensor 6, and a manual sheet feeding sensor 7.

The ROM 12 stores various programs for controlling the operation of the printer 10, and the CPU 11 stores the processed result in the RAM 13 to control the operation of the printer 10 in accordance with the program read by the ROM 12. Further, the CPU 11 performs a delay process as a post-printing process which will be described later. The timer 14 measures various times for the process of the CPU 11.

The operation section 15 includes a plurality of buttons, and can perform various input operations such as instruction to print the sheet 3 by a user. The display section 16 includes a liquid crystal display and a lamp, and can display various set screens or operation states. The network interface 19 is connected to peripheral devices, such as PC, via a communication cable NT, and can communicate mutually with the devices.

3. Delay Process of Post-Printing Process (Cleaning Process)

Next, the post-printing process (one example of quality assurance operation), for example, a delay process of cleaning operation of the image forming section 17, will now be described with reference to FIGS. 3 to 7. In this instance, the same process in each flowchart is designated with the same step number, and its description will be omitted. Also, each process is performed by the CPU 11 in accordance with a predetermined program stored in the ROM 12.

3-1. Overall Control of Printing Process

First, the overall control of the printing process will be described in brief with reference to FIG. 3.

The printing process starts when the power source of the printer 10 is turned on. If the power source is turned on, the CPU 11 performs a warm-up control for the printing, for example, a pre-heating control of the fixing unit 25 (step S10). Then, if a printing command is received from the operation section 15 or the PC, the CPU 11 determines whether a printing instruction can be carried or not. That is, the CPU 11 determines whether or not the printing instruction to start the sheet feeding to print the print data can be carried out for the sheet 3 in the tray sheet feeding section 30 or the manual sheet feeding section 40, based on the detected signal from a sheet sensor (not illustrated) provided in the tray T1 or the manual sheet feeding sensor 7 (step S20).

If it is determined that the printing instruction can be carried out (YES in step S20), the printing instruction is issued to perform the pre-printing process prior to sheet feeding (step S30). The pre-printing control includes, for example, a heating control of the fixing unit 25, and a color deviation correction control. If there is no printing command, or there is no sheet 3 in the tray sheet feeding section 30 or the manual sheet feeding section 40 even though there is the printing command, the CPU determines that the printing instruction cannot be carried out (NO in step S20), and thus suspends the execution of the printing command or waits until the sheet 3 is set in the tray sheet feeding section 30 or the manual sheet feeding section 40.

Then, the CPU 11 controls the pick-up roller 31 or the registration roller 22 to control the feeding of an nth (n is positive integer) sheet 3 (step S40). The conveyance mechanism 20 is controlled to convey the nth sheet 3 to the image forming section 17, and then the image forming section 17 is controlled to start forming the image on the nth sheet 3 (step S50).

Then, the CPU 11 determines whether or not the printing instruction for the (n+1)th sheet 3 can be carried out (step S60). If it is determined that the printing instruction can be carried out (YES in step S60), the CPU increments the number n of printed sheets (step S70), and returns to the process of step S40.

Meanwhile, if it is determined that the printing instruction can not be carried out (NO in step S60), for example, after if a number of sheets instructed to be printed have been printed, the post-printing process is performed (step S80). Then, the processing returns to step S20 to wait for a next printing command. Here, the CPU 11 performs the cleaning operation of the image forming section 17 as the post-printing process. In this way, since the image forming section 17 is cleaned after the printing, the formed image can be maintained to a predetermined quality.

3-2. Control of Manual Feeding Printing

Figure 4:
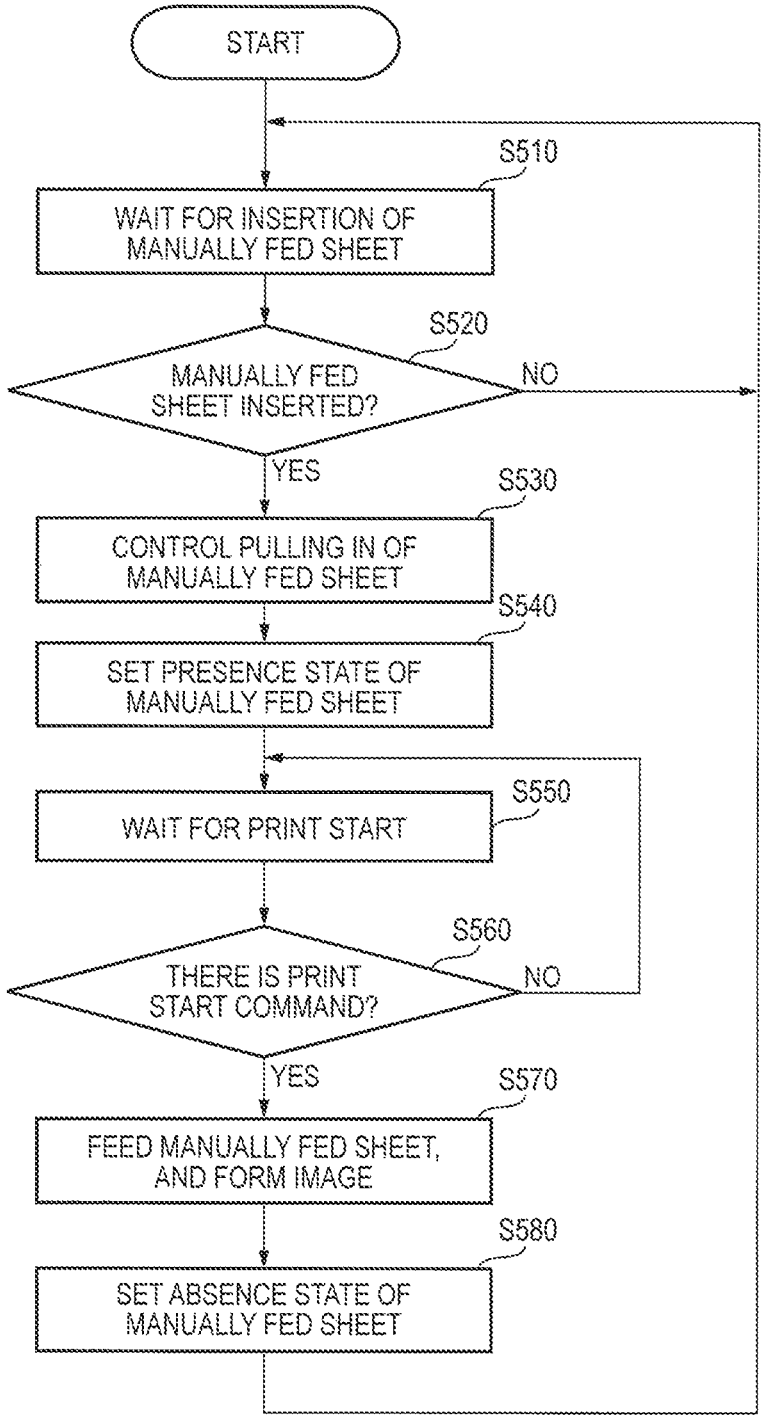
FIG. 4 is a flowchart schematically illustrating a manual sheet feeding control.

Next, the control of the manual feeding printing will be described in brief with reference to FIG. 4. The control of the manual feeding printing is performed by the CPU 11 in parallel with the above-described overall control of the printing process in accordance with the predetermined program stored in the ROM 12.

The CPU 11 waits for the sheet (manually fed sheet) 3 to be inserted into the first conveyance path P1 through the opening 42 of the manual sheet feeding section 40 (step S510). Then, the CPU determines that the manually fed sheet 3 is inserted into the first conveyance path P1 based on the detected signal from the manual sheet feeding sensor 7 (step S520). If it is determined that the manually fed sheet 3 is inserted into the first conveyance path P1 (YES in step S520), the manually fed sheet 3 is pulled in (step S530), and the CPU sets the presence state of the manually fed sheet, for example, as "1" in a manual sheet feeding flag (a predetermined region secured in the RAM 13) (step S540).

Then, the CPU 11 waits for a print start command from the operation section 15 or a print start command from the PC (step S550). The CPU determines whether or not there is the print start command (step S560), and if there is the print start command (YES in step S560), the conveyance mechanism 20 is controlled to convey the manually fed sheet 3 to the image forming section 17. The image forming section 17 is controlled to start forming the image on the manually fed sheet 3 (step S570).

For example, based on the signal detected by the manual sheet feeding sensor 7 to detect a trailing end of the manually fed sheet 3, the CPU sets the absence state of the manually fed sheet as "0" in the manual feeding flag (step S580). Then, the processing returns to step S510 to wait for insertion of a next manually fed sheet 3.

3-3-1. Delay Process of Post-Printing Process (First Exemplary Embodiment)

Next, the delay process of the post-printing process according to the first exemplary embodiment will be described with reference to FIG. 5. In the first exemplary embodiment, the delay process of the post-printing process is performed based on the past information.

Figure 5:
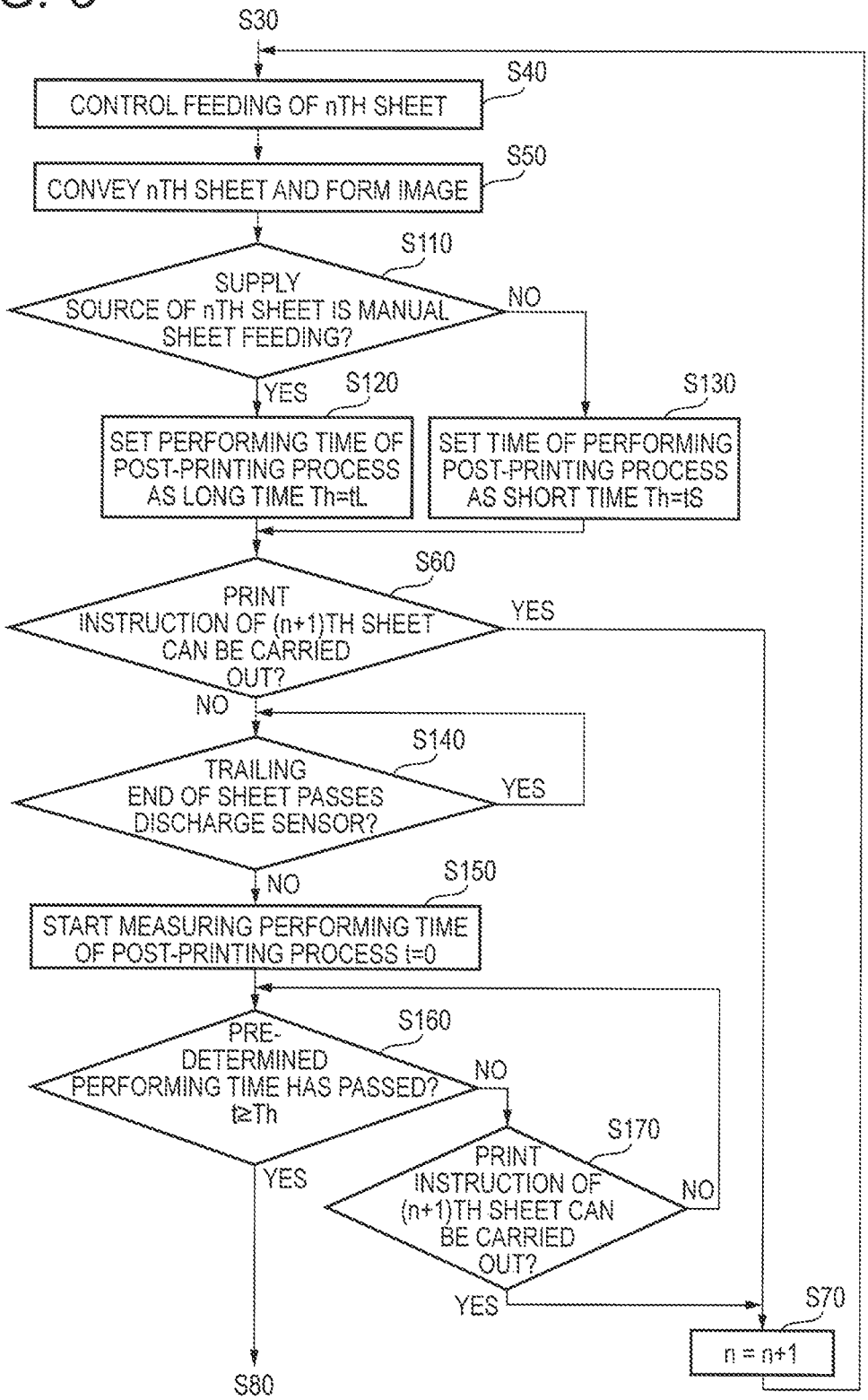
FIG. 5 is a flowchart illustrating an exemplary embodiment of a delaying process of a post-printing process.

The CPU 11 conveys the nth sheet 3 to the image forming section 17 in step S50 in FIG. 5, and controls the image forming section 17. If the image formation on the nth sheet 3 starts, the CPU determines whether or not a supply source of the nth sheet 3 is the manual sheet feeding section 40, for example, based on the detected signal of the manual sheet feeding sensor 7 (manual sheet feeding flag) and the pre-registration sensor 5 (step S110). The determination process of step S110 is one example of "determining whether or not it is necessary for the user to set the sheets in the sheet feeding section prior to the image forming operation".

If it is determined that the supply source of the nth sheet 3 is the manual sheet feeding section 40 (YES in step S110), a post-printing process performing time Th is set to a long time tL (step S120). Meanwhile, if it is determined that the supply source of the nth sheet 3 is not the manual sheet feeding section 40 (NO in step S110), the post-printing process performing time Th is set to a short time tS (step S130). That is, there is a relation of $tS<tL$.

The process of step S120 is one example of "the extending of the predetermined time". That is, the CPU 11 performs the extension process of extending the post-printing process performing time tL (one example of the predetermined time) when it is determined in S110 that it is necessary for the user to set the sheet in the sheet feeding section prior to the image forming operation to be longer than the post-printing process performing time tS (one example of the predetermined time) when it is determined in S110 that it is not necessary for the user to set the sheet in the sheet feeding section prior to the image forming operation. That is, for example, in the case where the short time tS of the post-printing process performing time Th is a normal time of the performing time, the long time tL of the post-printing process performing time Th is a time which is longer than the normal time (short time tS) and is extended from the short time tS.

In this instance, the CPU 11 may change the predetermined time Th to be extended in the extension process of step S120 depending on a type of the sheet. In general, a conveyance time of the sheet varies depending on the type of sheet, for example, a size or a material. For this reason, as the extending amount of the predetermined time Th is changed depending on the type of the sheet, wasteful driving of the image forming section 17 is reduced, thereby extending an operating life of the image forming section 17.

Then, if it is determined that the instruction to print the (n+1)th sheet 3 can not be carried out, that is, there is no (n+1)th sheet 3 (NO in step S60), the CPU determines whether or not the trailing end of the nth sheet 3 passes the discharge sensor 8 (step S140). If it is determined that the trailing end of the nth sheet 3 passes the discharge sensor 8 (YES in step S140), the CPU 11 instructs the timer 14 to start measuring the post-printing process performing time Th (step S150).

The CPU determines whether or not the measured time t passes the set post-printing process performing time Th (step S160). If the measured time t passes the post-printing process performing time Th (YES in step S160), the CPU 11 performs the cleaning operation of the image forming section 17 as the post-printing process (step S80).

Meanwhile, if the measured time t does not pass the post-printing process performing time Th (NO in step S160), the CPU determines whether or not the instruction to print the (n+1)th sheet 3 can be carried out (step S170). If it can be carried out (YES in step S170), the CPU increments the number n of the sheets (step S70) and returns to the process of step S40.

Here, the post-printing process of step S80 is an example of the quality assurance process. That is, if there is no sheet 3 (one example of the resource necessary for the image forming operation) after the post-printing process performing time Th (one example of the predetermined time) has elapsed from an end of the image forming operation, the CPU 11 performs the quality assurance process of causing the image forming section to perform the quality assurance operation to assure the quality of the image.

In the printing process in the first exemplary embodiment, the CPU 11 performs the image forming process (step S50) of causing the image forming section 17 to perform the image forming operation, the quality assurance process (step S80) of causing the image forming section 17 to perform the cleaning operation (quality assurance operation to assure the quality of the image) if the sheet 3 (resource necessary for the image forming operation) is not available for the post-printing process performing time Th from the end of the image forming operation, the determination process (step S110) of determining whether or not it is necessary for the user to set the sheet 3 in the sheet feeding section prior to the image forming operation, and the extension process (step S120) of extending the predetermined time (Th=tL) when it is determined that it is necessary for the user to set the sheet in the sheet feeding section prior to the image forming operation to be longer than the predetermined time (Th=tS) when it is determined that it is not necessary for the user to set the sheet in the sheet feeding section prior to the image forming operation.

3-3-2. Delay Process of Post-Printing Process (Second Exemplary Embodiment)

Next, the delay process of the post-printing process will be described with reference to FIG. 6. In the delay process of the post-printing process according to the second exemplary embodiment, the delay process of the post-printing process is performed based on print data to be printed.

Figure 6:
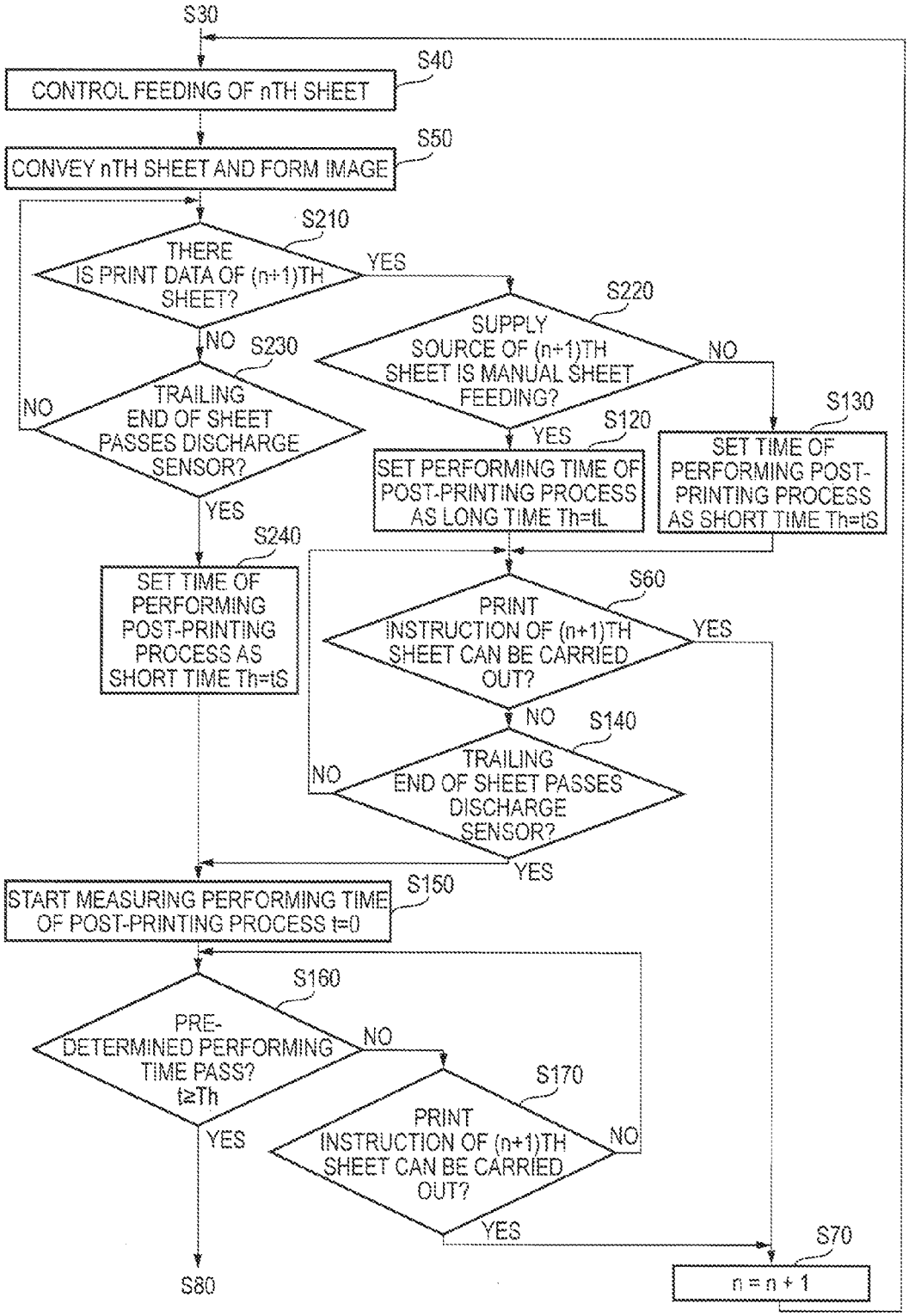
FIG. 6 is a flowchart illustrating another exemplary embodiment of a delaying process of a post-printing process.

The CPU 11 conveys the nth sheet 3 to the image forming section 17 in step S50 in FIG. 6, and controls the image forming section 17 to start the formation of the image on the nth sheet 3. Then, the CPU determines whether or not the print data to be printed on the next (n+1)th sheet 3 is available, based on, for example, whether the print data for printing the (n+1)th sheet 3 is received or not (step S210).

If it is determined that the print data of the (n+1)th sheet 3 is available, that is, if the print data of the (n+1)th sheet 3 is received from the PC (YES in step S210), the CPU determines whether or not the supply source of the (n+1)th sheet 3 is the manual sheet feeding section 40, for example, based on the print set information from the PC (step S220). In other words, it is determined whether or not the print data of the (n+1)th sheet 3 is the data for manual sheet feeding print. Here, the determination process of step S220 is one example of determining whether or not it is necessary for a user to set the sheet in the sheet feeding section prior to the image forming operation.

If it is determined that the supply source of the (n+1)th sheet 3 is the manual sheet feeding section 40 (YES in step S220), the post-printing process performing time Th is set to the long time tL (step S120). Meanwhile, if it is determined that the supply source of the (n+1)th sheet 3 is not the manual sheet feeding section 40 (NO in step S220), the post-printing process performing time Th is set to the short time tS (step S130).

Then, if it is determined that the instruction to print the (n+1)th sheet 3 can not be carried out (NO in step S60), the CPU determines whether or not the trailing end of the nth sheet 3 has passed the discharge sensor 8 (step S140). If it is determined that the trailing end of the nth sheet 3 has passed the discharge sensor 8 (YES in step S140), the CPU 11 instructs the timer 14 to start measuring the post-printing process performing time Th (step S150).

If it is determined that the instruction to print the (n+1)th sheet 3 can be carried out (YES in step S60), the CPU increments the number n of the sheets (step S70), and returns to the process of step S40.

If it is determined that the print data of the (n+1)th sheet 3 is not available, that is, if the print data of the (n+1)th sheet 3 is not received from the PC (NO in step S210), the CPU determines whether or not the trailing end of the nth sheet 3 has passed the discharge sensor 8 (step S230). If it is determined that the trailing end of the nth sheet 3 has passed the discharge sensor 8 (YES in step S230), the CPU 11 sets the post-printing process performing time Th as the short time tS (step S240). Since there is no print data of the (n+1)th sheet 3, it is regarded that the printing process is terminated at the nth sheet 3.

The CPU 11 instructs the timer 14 to start measuring the post-printing process performing time Th (step S150). Then, if the measured time t passes the post-printing process performing time Th (YES in step S160), the CPU 11 performs the cleaning operation of the image forming section 17 as the post-printing process (step S80).

That is, in the second exemplary embodiment, if the print data (one example of the resource necessary for the image forming operation) is not available for the post-printing process performing time Th (one example of the predetermined time) from the end of the image forming operation, the CPU 11 performs the quality assurance process of making the image forming section to perform the quality assurance operation to assure the quality of the image.

In the printing process of the second exemplary embodiment, the print data (image data) is used as the resource necessary for the image forming operation. The CPU 11 determines whether or not the user needs to set the sheet in the sheet feeding section prior to the image forming operation, based on whether or not the image data is data for the manual sheet feeding print (step S220).

3-4. Insertion Demanding Process of Manually Fed Sheet

Figure 7:
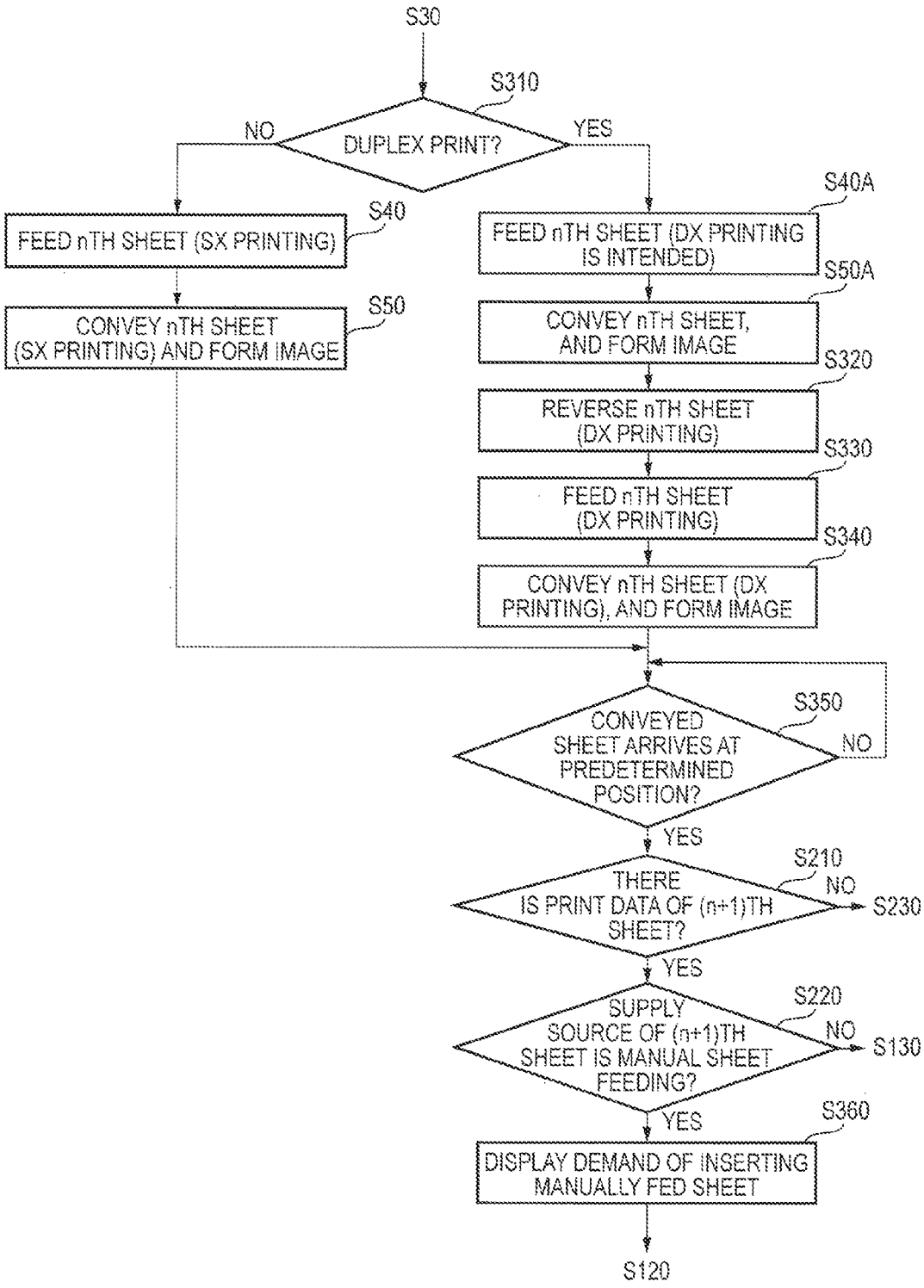
FIG. 7 is a flowchart schematically illustrating an insertion demanding process of demanding insertion of manually fed sheet.

Next, the insertion demanding process of the manually fed sheet will be described with reference to FIG. 7. The demanding process of the manually fed sheet is performed in the case where the delay process of the quality assurance operation based on the print data to be printed is performed in the second exemplary embodiment.

Figure 3:
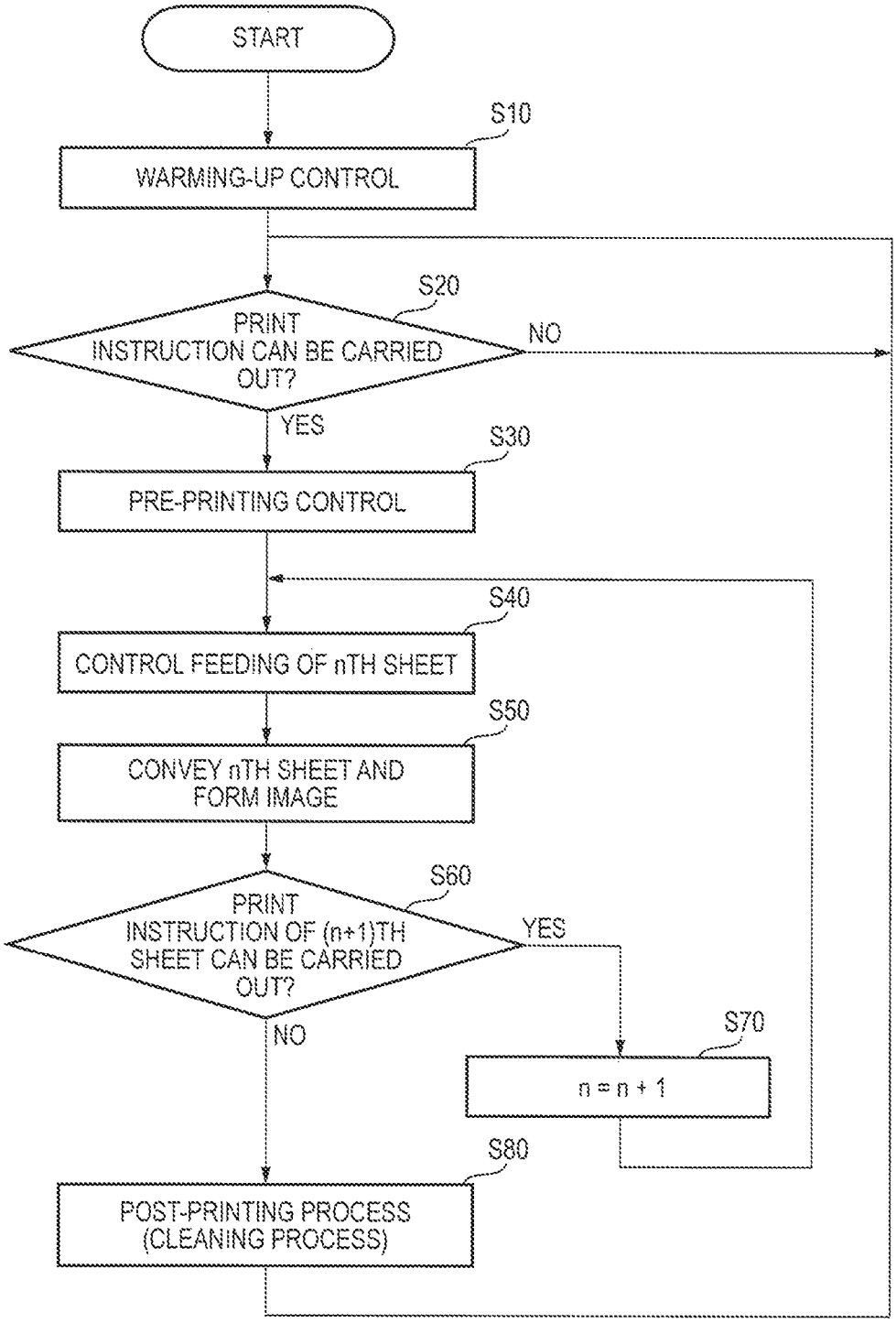
FIG. 3 is a flowchart schematically illustrating the entire control of a printing process.

After the post-printing control (step S30) illustrated in FIG. 3, the CPU 11 determines whether or not the printing of the nth sheet 3 is the duplex printing (DX), for example, based on the print instructing information from the PC (step S310). If it is determined that the printing of the nth sheet 3 is the duplex printing (YES in step S310), the printing on one surface of the sheet 3 is performed (step S40A and step S50A). Then, the CPU 11 controls the sheet reversing mechanism 70 to reverse the conveying direction of the sheet 3 (step S320). The CPU supplies the sheet 3 via the reverse conveyance path 73 (step S330) and conveys the nth sheet 3 with a printing surface reversed to the image forming section 17, and controls the image forming section 17 to start forming the image on the other surface of the nth sheet 3 (step S340).

In this instance, if the printing of the nth sheet 3 is the simplex printing (SX printing) (NO in step S310), the process (steps S40 and S50) is performed to a surface of the nth sheet 3.

Then, the CPU 11 determines whether or not the trailing end of the nth sheet 3 arrives at a predetermined position (step S350). Here, the predetermined position is, for example, an installed position of the post-registration sensor 6. If it is determined that the trailing end of the nth sheet 3 arrives at the predetermined position, that is, if the CPU 11 receives the detected signal detecting the trailing end of the nth sheet 3 from the post-registration sensor 6 (YES in step S350), as illustrated in FIG. 6, the CPU determines whether or not the print data of the (n+1)th sheet 3 is available (step S210).

If it is determined that the print data of the (n+1)th sheet 3 is available (YES in step S210), and if it is determined that the supply source of the (n+1)th sheet 3 is the manual sheet feeding section 40 (YES in step S220), the CPU 11 displays a demanding indication for demanding insertion of the manually fed sheet into the manual sheet feeding section 40 on the display section 16 (step S360). Then, as illustrated in FIG. 6, the processes after step S120 are performed.

In this instance, the CPU 11 may change a display timing of the demanding indication to be displayed on the display section depending on whether the simplex printing or the duplex printing has been set for a previous image formation to the sheet. In this case, the demanding indication can be displayed at an optimum timing at the simplex printing and the duplex printing, respectively. For example, in the case where the simplex printing is set for the previous image formation to the sheet, an image forming efficiency can be improved by setting the display timing of the demanding indication earlier than that of the case where the duplex printing is set for the previous image formation to the sheet. The reason is because the time necessary for the simplex printing is shorter than that of the duplex printing.

Also, the CPU 11 may start displaying the demanding indication on the display section 16 before the cleaning operation (quality assurance operation) starts. In this instance, it is possible to suppress the process from being transferred to the quality assurance operation easily in the case where the image forming operation is continuously performed by the manual feeding printing.

The CPU 11 may continuously display the demanding indication on the display section 16 after the cleaning operation starts. In this case, it is possible to suppress the user from misrecognizing that the data for the manual feeding printing is canceled by the quality assurance operation.

4. Effects of the Exemplary Embodiment

In the case where it is necessary for the user to set the sheet 3 in the sheet feeding section prior to the image forming operation, for example, in the case of the manual feeding printing in which the sheet 3 is fed to the manual sheet feeding section 40, the supply of the sheet 3 to the image forming section 17 may be delayed than the image forming operation in which the user does not need to set the sheet 3 in the sheet feeding section 3, for example, the tray sheet feeding printing in which the sheet 3 is set in the tray sheet feeding section 30. As a result, if the image forming operation is completed and the quality assurance process is performed, the continuous image forming operation cannot be performed, thereby probably reducing productivity. However, in the exemplary embodiment, the CPU 11 performs the determination process (step S110) of determining whether or not it is necessary for the user to set the sheet 3 in the sheet feeding section prior to the image forming operation, and the extension process (step S120) of extending the predetermined time tL in the case where the result of the determination is affirmative in the determination process than the predetermined time tS in the case where the result of the determination is negative in the determination process. For this reason, for example, in the case of the manual feeding printing, since the determined time Th from the end of the previous image forming operation until the cleaning process (quality assurance process) of the image forming section 17 is performed is extended, it is possible to suppress the process from being transferred to the quality assurance operation easily, thereby securing the productivity.

In the case where the image forming operation is performed on the sheet 3 conveyed via the first conveyance path P1 after the image forming operation is performed on the sheet 3 conveyed via the second conveyance path P2, the CPU 11 receives the first detection information from the post-registration sensor 6 (the first detecting unit), and then displays the demanding indication of setting the sheet 3 in the manual sheet feeding section 40 on the display section 16. According to this configuration, even in a case where it is difficult for the user to visually know the timing at which the sheet 3 conveyed via the second conveyance path P2 passes the junction point G1, it is possible to know the appropriate timing of inserting the sheet into the manual sheet feeding section 40.

At that time, the second conveyance path becomes the reverse conveyance path 73 (re-conveyance path) for reversing the sheet with the image formed on one side thereof and again conveying the sheet to the image forming section 17. In general, in the case where the sheet 3 of which the image is formed on the other side is being conveyed, it is further hard to take the timing of setting the sheet 3 in the manual sheet feeding section 40. However, the proper sheet inserting timing is taken by the insertion demanding indication of the sheet into the manual sheet feeding section 40.

Other Embodiments

The present invention is not limited to the above description and the exemplary embodiments illustrated in the accompanying drawings. For example, the following embodiments are also included within the technical scope of the invention.

(1) The above embodiment illustrates the example in which the sheet feeding section is selected as the manual sheet feeding section 40 in the determination process determining whether or not the user needs to set the sheets in the sheet feeding section before the image forming operation, but the present invention is not limited thereto. The sheet feeding section may be the tray sheet feeding section 30. That is, the determination process includes determining whether or not the sheet is set in the tray sheet feeding section 30 when there is no sheet in the tray sheet feeding section 30 during the automatic printing.

(2) The determination process of determining whether or not the user needs to set the sheets in the sheet feeding section before the image forming operation may be a determination process of determining whether the manual sheet feeding sensor 7 is turned on or not (by the sheet slightly inserted by the user) during the printing.

(3) The above embodiment illustrates the example in which the resource necessary for the image forming operation is the image data (print data) for forming the image or the sheet. However, the present invention is not limited thereto. Both the image data and the sheet may be used as the resource necessary for the image forming operation.

What is claimed is:

1. An image forming apparatus comprising:

a sheet feeding section configured to feed a sheet;

an image forming section configured to perform an image forming operation of forming an image on the sheet fed from the sheet feeding section; and a control device configured to:

cause the image forming section to perform the image forming operation, cause the image forming section to perform a quality assurance operation for assuring a quality of an image, if a resource necessary for the image forming operation is not available for a predetermined time from an end of the image forming operation, determine whether or not it is necessary for a user to set the sheet in the sheet feeding section prior to the image forming operation, and extend the predetermined time when it is determined that it is necessary for the user to set the sheet in the sheet feeding section prior to the image forming operation to be longer than the predetermined time when it is determined that it is not necessary for the user to set the sheet in the sheet feeding section prior to the image forming operation.

2. The image forming apparatus according to claim 1, wherein the sheet feeding section includes a manual sheet feeding section configured to feed the sheet inserted by the user each time the image forming operation is performed to the sheet, and wherein the control device is further configured to:

determine that it is necessary for the user to set the sheet in the manual sheet feeding section prior to the image forming operation if manual feeding printing, in which the image is formed on the sheet fed from the manual sheet feeding section, is set.

3. The image forming apparatus according to claim 1, wherein the resource necessary for the image forming operation includes at least one of image data for forming the image and the sheet.

4. The image forming apparatus according to claim 2, further comprising:

a first conveyance path configured to convey the sheet from the manual sheet feeding section;

a second conveyance path that joins with the first conveyance path;

a first detection unit configured to detect passing of the sheet at a junction of the first conveyance path and the second conveyance path and then output first detection information to the control device; and a display section, wherein the control device is further configured to:

display a demanding indication of setting the sheet in the manual sheet feeding section on the display section after receiving the first detection information, when performing the image forming operation to the sheet being conveyed via the first conveyance path after the image forming operation has been performed to the sheet conveyed via the second conveyance path.

5. The image forming apparatus according to claim 4, wherein the second conveyance path is a re-conveyance path configured to reverse the sheet on which an image is formed on one side thereof and then convey the reversed sheet to the image forming section again.

6. The image forming apparatus according to claim 4, wherein the control device is further configured to:

change a display timing of the demanding indication to be displayed on the display section depending on whether a simplex printing or a duplex printing has been set for a previous image formation to the sheet.

7. The image forming apparatus according to claim 6, further comprising a second detection unit configured to detect the sheet passing the first conveyance path and output a second detected signal to the control device, wherein the control device is further configured to:

display the demanding indication on the display section after receiving the second detected signal, if the simplex printing has been set for the previous image formation to the sheet.

8. The image forming apparatus according to claim 4, wherein the control device is further configured to:

cause the display section to start displaying the demanding indication before the start of the quality assurance operation.

9. The image forming apparatus according to claim 1, wherein the control device is further configured to:

determine whether a sheet is manually fed; and change the predetermined time depending on whether the sheet is manually fed.

10. The image forming apparatus according to claim 1, wherein the quality assurance operation includes a cleaning operation of cleaning the image forming section.

* * * * *